United States Patent [19]

Wöhrle et al.

[11] Patent Number: 4,495,888

[45] Date of Patent: Jan. 29, 1985

[54] COATING MECHANISM

[75] Inventors: Albert Wöhrle, Heidenheim; Franz Krautzberger, Heidenheim-Grosskuchen, both of Fed. Rep. of Germany

[73] Assignee: J. M. Voith GmbH, Heidenheim, Fed. Rep. of Germany

[21] Appl. No.: 495,249

[22] Filed: May 17, 1983

[30] Foreign Application Priority Data

May 28, 1982 [DE] Fed. Rep. of Germany ..... 3220075

[51] Int. Cl.[3] ..... B05C 5/02

[52] U.S. Cl. ..... 118/410; 118/413

[58] Field of Search ..... 118/413, 410

[56] References Cited

U.S. PATENT DOCUMENTS 4,250,211 2/1981 Damrau et al. ..... 118/413 X 4,405,661 9/1983 Alheid ..... 118/413 X

*Primary Examiner*—John P. McIntosh

*Attorney, Agent, or Firm*—Jeffers, Irish & Hoffman

[57] ABSTRACT

A coating mechanism for coating continuous webs of product, especially paper products, comprising a support member having a coating blade supported thereon by a clamping device, the coating blade having a coating surface and a coating edge. The coating blade and the web of product form therebetween an application slot, and the clamping device includes an expansible pressure member adapted to contain a pressure medium. A pressure chamber is installed on the support member and is tiltable about an axis disposed between the pressure member and the coating blade so as to transfer the expansion force of the pressure member to the coating blade. The pressure chamber has an opening therein and is adapted to supply a coating composition through the opening to the application slot for application by the coating blade onto the web of product.

7 Claims, 1 Drawing Figure

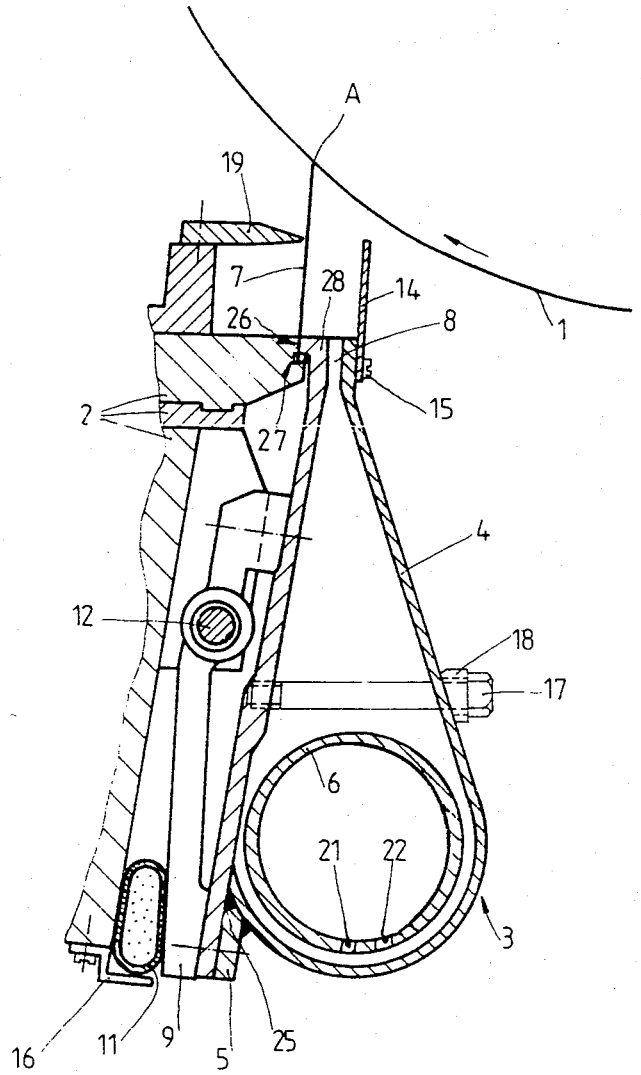
A
19
7
28
14
26
8
1
2
27
15
4
12
18
17
6
21
22
3
16
11
9
5
25

COATING MECHANISM

DESCRIPTION OF RELATED ART

A representative prior art coating mechanism is disclosed in U.S. Pat. No. 4,250,211 wherein the pressure chamber, which receives the coating composition and which leads to the coating blade and the web to be coated, is formed in part by the walls of the supporting member which also includes a holding device for the coating blade. The remaining portion of the pressure chamber is formed by tiltable walls rigidly connected together. In FIG. 7 of U.S. Pat. No. 4,250,211, the holding device for the coating blade has a deformable pressure member which can be charged with a pressure medium. By charging the pressure member, the coating blade is forced into the holding device and secured therein. Further, in the area of the holding device there is provided a means for pressing the coating blade against the web of product. A disadvantage with this is that only a narrow limited space is available in the vicinity of the web of product or in the vicinity of the counterrollers, which support the web of product, to accommodate the holding device and the adjustment means for pressing the coating blade against the web of product. An additional disadvantage is that the coating composition, which reaches the trailing side of the coating blade, may contaminate the holding device and adjusting means, thereby degrading their operation.

In contrast to this, an object of the present invention is to provide a coating mechanism which eliminates the above problem of limited available space and the danger of contamination of the holding device and adjusting means.

According to the present invention, the pressure member is installed away from the coating blade and protected by a portion of the supporting member so as not to be contaminated by the coating composition. Moreover, by installing the pressure member away from the vicinity of the coating blade, there is no problem associated with limited available space in the area of the web of product and coating blade.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawing of a partially sectional side elevational view of a preferred embodiment of the present invention.

DESCRIPTION OF A PREFERRED EMBODIMENT

Supporting member 2 is provided for the purpose of holding coating blade 7, and supporting member 2 is installed in a tiltable manner so that it can pivot around point A of coating blade 7 on the web of product or counterroller 1. In addition, supporting member 2 may also be tilted in such a way that coating blade 7 is tilted away rom counterroller 1 or the web 1 of product. These devices for tilting supporting member 2 are generally known in the art and will not be discussed in any greater detail. In order to force coating blade 7 onto the web 1 of product with a greater pressure, there is an adjustable straight-edge 19 which is movable by a sliding holder (not shown) relative to coating blade 7.

Again, such mechanisms are generally known and described in U.S. Pat. No. 4,250,211.

In the present invention, coating blade 7 is pressed onto supporting member 2 by means of nose 28 of pressure chamber 3 by means of continuous groove 26 or the corresponding projecting edge 27 of supporting member 2. Pressure chamber 3 serves the purpose of receiving a coating composition which is forced through slot opening 8 towards the web 1 of product. For this purpose, plate 14 is attached adjacent the slot opening 8 of pressure chamber 3 by fastener 15 so that a canal is formed between blade 7 and plate 14 in which the coating composition will flow upwardly towards web 1 of the product. Excess coating composition is wiped off by coating blade 7 and drops downwardly therefrom. It may now be seen that dripping or excess coating composition on both sides of coating blade 7 cannot contaminate pressure member 11. Pressue member 11, which may be a flexible tube, is charged internally with a liquid or gaseous pressure agent which causes pressure member 11 to apply an expansion force against support lever 9, which has lower part 5 of pressure chamber 3 attached thereto. Generally, this attachment is accomplished by means of bolts as indicated in the drawing in dash-dot lines. The remaining portion of pressure chamber 3 is formed of a cover 4 fastened to lower part 5 by means of bolt 17. In order for bolt 17 to be satisfactorily installed on cover 4, a reinforcement piece 18 is welded to cover 4. Support lever 9 can be tilted or pivoted around bearing pin 12 installed in support member 2.

Angle piece 16 is provided for the purpose of holding pressure member 11 to prevent it from falling downwardly when no load or pressure is applied thereagainst. Alternately, pressure member 11 may be attached to either supporting member 2 or support lever 9. The coating composition reaches pressure chamber 3 via chamber tube 6 installed inside pressure chamber 3 through openings 21, 22 provided in the lower portion of tube 6. There is a gasket 25 located at the junction of lower part 5 and cover 4 to prevent leakage of the coating composition from pressure chamber 3.

Pressure chamber 3 can be easily dismantled for cleaning the inside thereof. Such cleaning is generally only necessitated in exceptional cases, thereby eliminating the disadvantage with the coating mechanism described in U.S. Pat. No. 4,250,211.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. Coating mechanism for coating continuous webs of product, especially paper, including a horizontal supporting member having a coating blade held thereon by clamping means and having a coating surface and a coating edge, said clamping means having at least one deformable pressure member spaced apart from said coating blade, said pressure member adapted to be connected to a source of pressure medium, said coating surface of said coating blade and the web of product forming therebetween an application slot, and a rigid pressure chamber having an opening therein and adapted for supplying a coating composition through said opening to said application slot for application of the composition to the web, characterized in that said pressure chamber is pivotally connected to said supporting member and pivotable about a pivot axis disposed intermediate the ends of said pressure chamber said axis further being between said coating edge of said coating blade and said pressure member, and said clamping means including said coating blade being securely pressed between said supporting member and said pressure chamber acting as a transfer medium for the expansion force of said pressure member.

2. The mechanism of claim 1 further including a mounting member mounted on said supporting member and having said pressure chamber connected thereto, said mounting member being disposed substantially between said supporting member and said pressure chamber.

3. The mechanism of claim 1 wherein said clamping means includes said coating blade being pressed between said supporting member and the portion of said pressure chamber having said opening therein.

4. The mechanism of claim 1 further including a lever means pivotally mounted on said supporting member for pivoting about said pivot axis, said pressure chamber being installed on said lever means on the opposite side from said supporting member, said pressure member disposed below said pivot axis and between said lever means and said supporting member, said pressure member being connected to one of said lever means and said supporting member.

5. A coating mechanism for coating continuous webs of product, especially paper products, comprising:

a supporting means having a coating blade supported thereon by a clamping means, said coating blade having a coating surface and a coating edge, said coating blade and the web of product forming therebetween an application slot, said clamping means including an expansible pressure member adapted to contain a pressure medium, and a pressure chamber installed on said support means and tiltable about a pivot axis, said axis being disposed intermediate the ends of said pressure chamber and also disposed between said pressure member and said coating blade so as to transfer the expansion force of said pressure member to said coating blade, said pressure chamber having an opening therein and adapted to supply a coating composition through said opening to said application slot, said clamping means supporting said coating blade by firmly pressing the whole of said pressure chamber against said support means with said coating blade disposed therebetween.

6. The mechanism of claim 5 wherein said pressure chamber is installed on said support means by a mounting element disposed between said pressure chamber and said support means.

7. The mechanism of claim 5 further including a lever means pivotally mounted on said support means for pivoting about said pivot axis, said pressure chamber being installed on said lever means on the opposite side from said support means, said pressure member disposed below said pivot axis and between said lever means and said supporting member, said pressure means being connected to one of said lever member and said support means.

* * * * *

UNITED STATES PATENT AND TRADEMARK OFFICE

CERTIFICATE OF CORRECTION

PATENT NO. : 4,495,888

DATED : January 29, 1985

INVENTOR(S) : Albert Wohrle and Franz Krautzberger

It is certified that error appears in the above—identified patent and that said Letters Patent is hereby corrected as shown below:

Col. 1, line 62, change "rom" to --from--.

Col. 2, line 18, change "pressue" to --pressure--.

Cl. 5, Col. 4, line 1, change "supporting" to --support--.

Signed and Sealed this

*Eleventh* Day of *June 1985*

[SEAL]

*Attest:*

DONALD J. QUIGG

*Attesting Officer* *Acting Commissioner of Patents and Trademarks*